US007636065B2

(12) United States Patent
Ohishi et al.

(10) Patent No.: US 7,636,065 B2
(45) Date of Patent: Dec. 22, 2009

(54) ANTENNA APPARATUS AND WIRELESS DEVICE

(75) Inventors: Takafumi Ohishi, Kawasaki (JP); Noriaki Oodachi, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 125 days.

(21) Appl. No.: 12/052,291

(22) Filed: Mar. 20, 2008

(65) Prior Publication Data

US 2009/0027286 A1 Jan. 29, 2009

(30) Foreign Application Priority Data

Jul. 27, 2007 (JP) ..... P2007-196234

(51) Int. Cl.
*H01Q 1/24* (2006.01)

(52) U.S. Cl. ..... 343/702; 343/876

(58) Field of Classification Search ..... 343/702, 343/846, 876

See application file for complete search history.

(56) References Cited

U.S. PATENT DOCUMENTS 7,027,000 B2 * 4/2006 Takagi et al. ..... 343/702

FOREIGN PATENT DOCUMENTS

JP 2006-042111 2/2006

* cited by examiner

*Primary Examiner*—Hoang V Nguyen
(74) *Attorney, Agent, or Firm*—Turocy & Watson, LLP

(57) ABSTRACT

According to an aspect of the invention, there is provided an antenna apparatus comprising: a substrate comprising an end portion; antenna elements connected to the end portion through a connecting portion; and a conductive line path provided between adjacent antenna elements, both ends of the conductive line path connected to the end portion. A distance between both ends of the conductive line path is shorter than a quarter wavelength of an operating frequency of the antenna elements. A path difference between a first path length from an connecting portion of one of the antenna elements to an connecting portion of the other of the antenna elements through both ends of the conductive line path and a second path length from the connecting portion of one of the antenna elements to the connecting portion of the other of the antenna elements through the conductive line path is a half wavelength of the operating frequency.

19 Claims, 9 Drawing Sheets

FIG. 3(a)
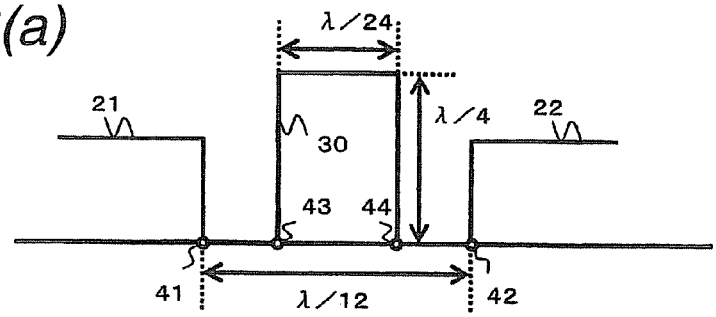
FIG. 3(b)
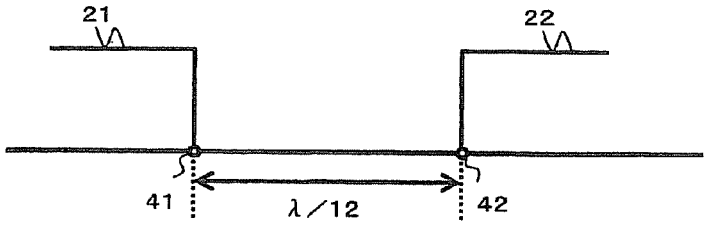
FIG. 3(c)
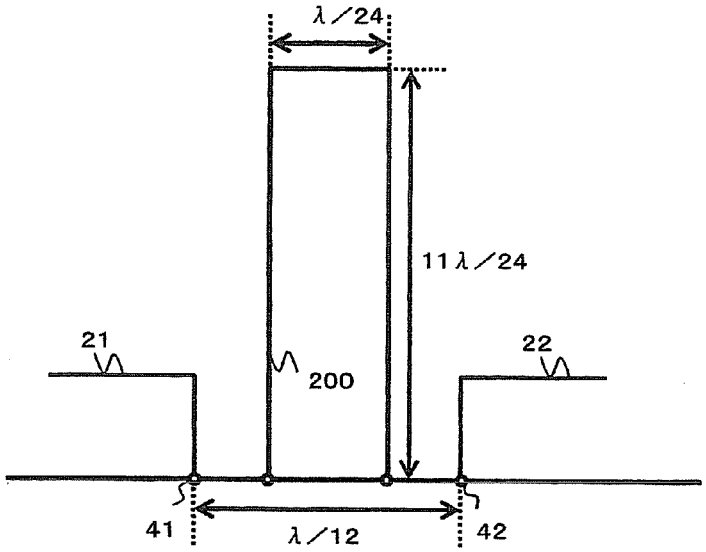
FIG. 4
| | ANTENNA APPARATUS ACCORDING TO EMBODIMENT OF FIG.3(a) | ANTENNA APPARATUS WHICH DOES NOT INCLUDE CONDUCTIVE LINE PATH 4 OF FIG.3(b) | ANTENNA APPARATUS ACCORDING TO BACK-GROUND ART OF FIG.3(c) |
|---|---|---|---|
| S21 | −12.6 dB | −6.4 dB | −7.4 dB |

FIG. 8
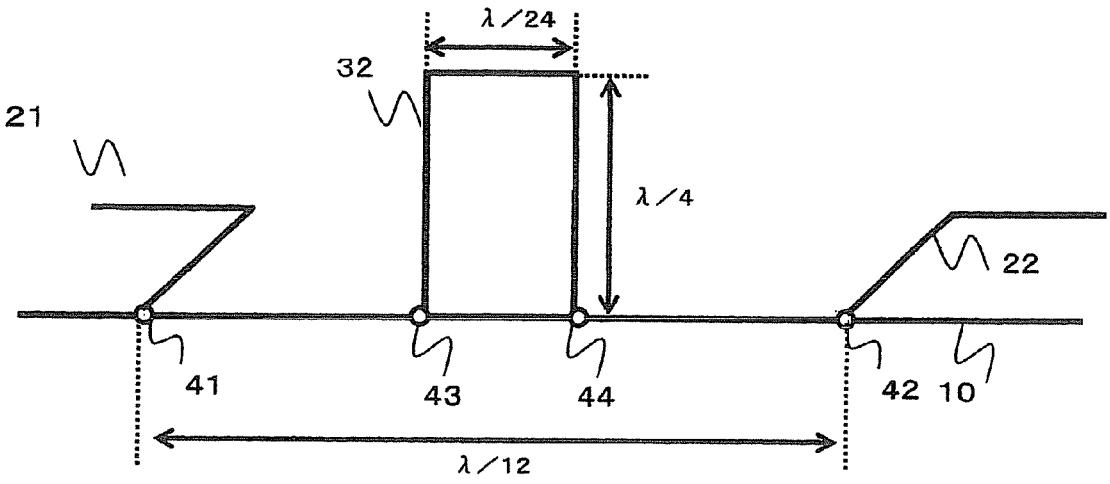
FIG. 9
| | ANTENNA APPARATUS ACCORDING TO EMBODIMENT OF FIG.9 | ANTENNA APPARATUS WHICH DOES NOT INCLUDE CONDUCTIVE LINE PATH 40 OF FIG.3(b) |
|---|---|---|
| S21 | −10.9 dB | −6.4 dB |
FIG. 10
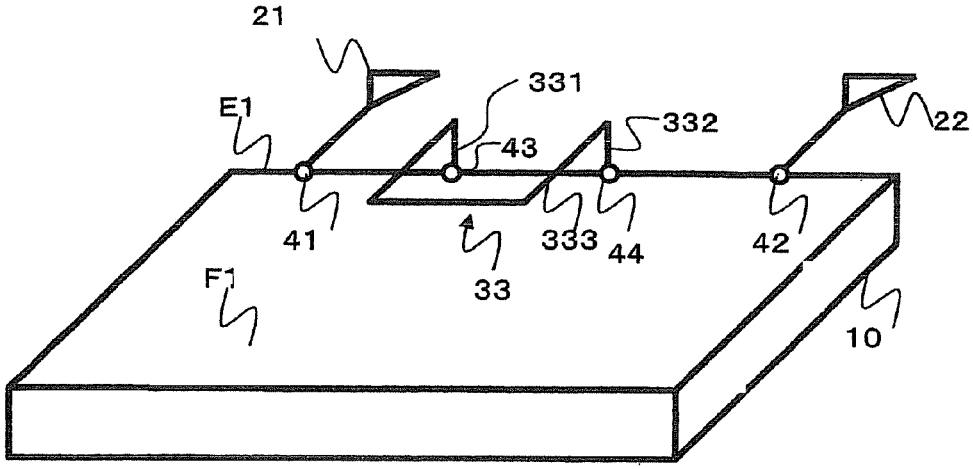

ANTENNA APPARATUS AND WIRELESS DEVICE

CROSS-REFERENCE TO RELATED APPLICATIONS

This application is based on and claims the benefit of priority from the prior Japanese Patent Application No. 2007-196234, filed on Jul. 27, 2007; the entire contents of which are incorporated herein by reference.

TECHNICAL FIELD

The present invention relates to an antenna apparatus and a wireless device.

BACKGROUND

In recent years, according to a portable telephone, a wireless device or the like, various wireless systems are mounted to one apparatus to be able to carry out wireless communication at any time and at anywhere. Generally, a wireless frequency allocated to a wireless system differs for respective wireless systems. Therefore, a wireless device dealing with a plurality of wireless systems is mounted with a plurality of pieces of antennas operated in accordance with frequencies allocated to the respective wireless systems, or a wide band antenna operable in accordance with a plurality of frequencies.

However, small-sized formation of a wireless device is progressed and it is difficult for a wireless device having a plurality of pieces of antennas to sufficiently maintain a distance between the antennas. Therefore, a problem that an isolation characteristic between the antennas is deteriorated is posed.

It is disclosed by, for example JP-A-2006-42111 (pages 2 through 6, FIG. 1), that an isolation characteristic between antennas is improved by restraining a current flowing at a base plate.

According to the antenna disclosed in JP-A-2006-42111, an isolation characteristic between antennas A, B is improved by providing a non power feed element in a linear shape constituting one wavelength of an operating frequency of an antenna by a loop path length including a base plate between the antennas A and B arranged at one side of the base plate.

This is because a current flowing at the non power feed element and a current flowing from the antenna A to the antenna B constitute phases inverse to each other between a substrate and a portion of the non power feed element connected thereto to cancel by each other, and therefore, the current flowing from the antenna A to the antenna B can be reduced.

However, according to a technique disclosed in JP-A-2006-42111, the loop path length of the non power feed element includes the base plate constitutes 1 wavelength of the operating frequency, and a current flowing at the main plate flows to the non power feed element and the non power feed element is resonated. When the loop of one wavelength formed by the non power feed element including the base plate is resonated, the antenna A and the non power feed element as well as the antenna B and the non power feed element are respectively coupled, as a result, the antenna element A and the antenna element B are coupled. Accordingly, it is difficult to improve an isolation characteristic between the antenna A and the antenna B.

Further, the non power feed element radiates a radio wave by resonance, and therefore, there poses a problem that radiation characteristics of the antennas A and B are deteriorated. Further, the loop path length needs to be as long as one wavelength. The non power feed element is enlarged, and it is difficult to mount a small-sized antenna apparatus.

SUMMARY

According to an aspect of the invention, there is provided an antenna apparatus including: a substrate including an end portion; a plurality of antenna elements connected to the end portion of the substrate through a connecting portion; and a conductive line path provided between two adjacent antenna elements of the plurality of antenna elements, both ends of the conductive line path connected to the end portion of the substrate. A distance between both ends of the conductive line path is shorter than a quarter wavelength of an operating frequency of the plurality of antenna elements. A path difference between a first path length defined from an connecting portion of one of the two adjacent antenna elements to an connecting portion of the other of the two adjacent antenna elements through both ends of the conductive line path and a second path length defined from the connecting portion of one of the two adjacent antenna elements to the connecting portion of the other of the two adjacent antenna elements through the conductive line path is a half wavelength of the operating frequency.

According to another aspect of the invention, there is provided an antenna apparatus including: a substrate comprising an end portion; an antenna element connected to the end portion of the substrate through a connecting portion; a circuit portion arranged on the substrate for carrying out a signal processing; and a conductive line path provided between the antenna element and the circuit portion, both ends of the conductive line path connected to the end portion of the substrate. A distance between both ends of the conductive line path is shorter than a quarter wavelength of an operating frequency of the antenna element. A first path is defined by a path from one end of the conductive line path connected to the substrate which is further from the antenna element than the other end of the conductive line path connected to the substrate to the connecting portion through the end portion of the substrate. A second path is defined by a path from the one end of the conductive line path to the connecting portion through the conductive line path. A path length difference of the first path and the second path becomes either one of a half wavelength of the operating frequency and a frequency of a signal to which the circuit portion carries out the signal processing.

According to still another aspect of the invention, there is provided a wireless device including: an antenna apparatus. The antenna apparatus includes; a substrate comprising an end portion; a plurality of antenna elements connected to the end portion of the substrate through a connecting portion; and a conductive line path provided between two adjacent antenna elements of the plurality of antenna elements. Both ends of the conductive line path are connected to the end portion of the substrate. A distance between both ends of the conductive line path is shorter than a quarter wavelength of an operating frequency of the plurality of antenna elements. A path difference between a first path length defined from an connecting portion of one of the two adjacent antenna elements to an connecting portion of the other of the two adjacent antenna elements through both ends of the conductive line path and a second path length defined from the connecting portion of one of the two adjacent antenna elements to the connecting portion of the other of the two adjacent antenna elements through the conductive line path is a half wavelength of the operating frequency.

BRIEF DESCRIPTION OF THE DRAWINGS

In the accompanying drawings:

FIG. 3 exemplary illustrates diagrams for explaining a constitution of an antenna apparatus used in a simulation according to the first embodiment;

FIG. 4 is an exemplary diagram showing a result of the simulation according to the first embodiment;

FIG. 8 is an exemplary diagram for explaining a constitution of an antenna apparatus used in a simulation according to the third embodiment;

FIG. 9 is an exemplary diagram for explaining a result of the simulation according to the third embodiment;

FIG. 10 is an exemplary view showing a constitution of an antenna apparatus according to a fourth embodiment of the invention;

DESCRIPTION OF THE EMBODIMENTS

Embodiments of the invention will be explained as follows in reference to the drawings.

Embodiment 1

Figure 1:
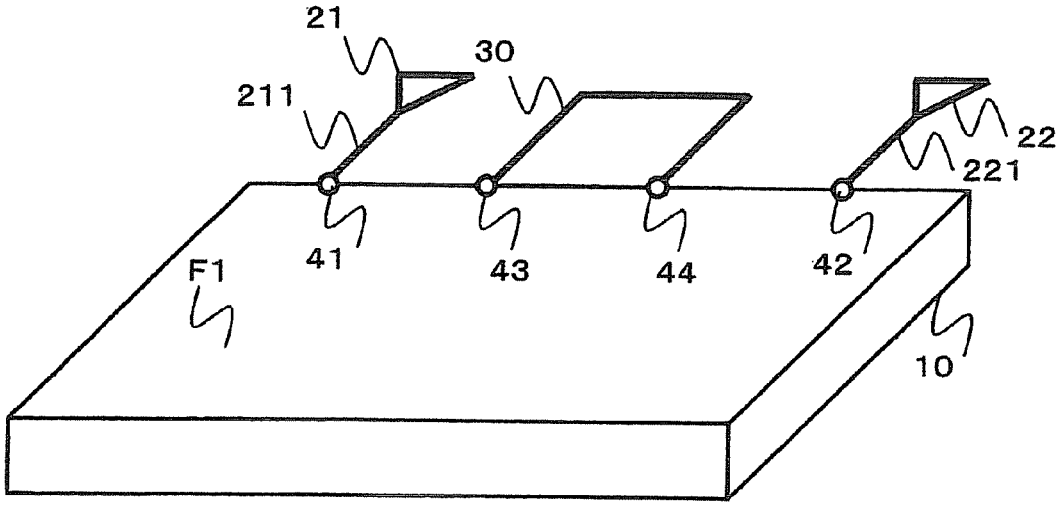
FIG. 1 is an exemplary view showing a constitution of an antenna apparatus according to a first embodiment of the invention.

A first embodiment of the invention will be explained in reference to FIG. 1 through FIG. 4. FIG. 1 is a view schematically showing an antenna apparatus according to the embodiment. The antenna apparatus is included in a wireless device having, for example, a wireless communication function.

The antenna apparatus shown in FIG. 1 includes a conductor base member 10 serving as a substrate, antenna elements 21 and 22 electrically connected to the conductor base member 10 serving as the substrate respectively by connecting portions 41 and 42, and a conductive line path 30 both ends of which are electrically connected to the conductor base member 10 serving as the substrate.

The conductor base member 10 is a multilayer substrate formed by a conductor, a dielectric member or the like. The conductor base member 10 is not limited to a plate-like shape but may be configured by a rectangular parallelepiped or a cube. For example, a face having a side provided with the antenna elements 21 and 22 may be provided with an area wider than that of other face. However, the face having the side provided with the antenna elements 21 and 22, for example, a face F1 is configured by a layer of a metal having a high conductivity of copper, silver, gold or the like.

The antenna elements 21 and 22 are electrically connected to the conductor main body 10 respectively by the connecting portions 41 and 42. The antenna elements 21 and 22 may be provided with liner portions 211 and 222, for example, a linear element antenna of an inverse L antenna, an inverse F antenna or the like, or a plate-like antenna element having a plate-like structure at a portion thereof may be used therefor. Further, the antenna elements 21 and 22 may not be constructed by the same constitution, and different antenna elements may be used such that one thereof is configured by an inverse L antenna and other thereof is configured by a plate-like antenna element. Further, the antenna elements 21 and 22 are configured by a metal having a high conductivity of copper, silver, gold or the like.

The conductive line path 30 is configured by a linear element of a metal having a high conductivity. The conductive path 30 may be configured by using, for example, a line path of a copper line or the like, and a micro strip line path may be constituted on a surface of a dielectric layer (not illustrated). Further, the conductive line path 30 is provided between the antenna elements 21 and 22, and both ends of which are electrically connected to the conductor base member 10 respectively by connecting portions 43 and 44.

Figure 2:
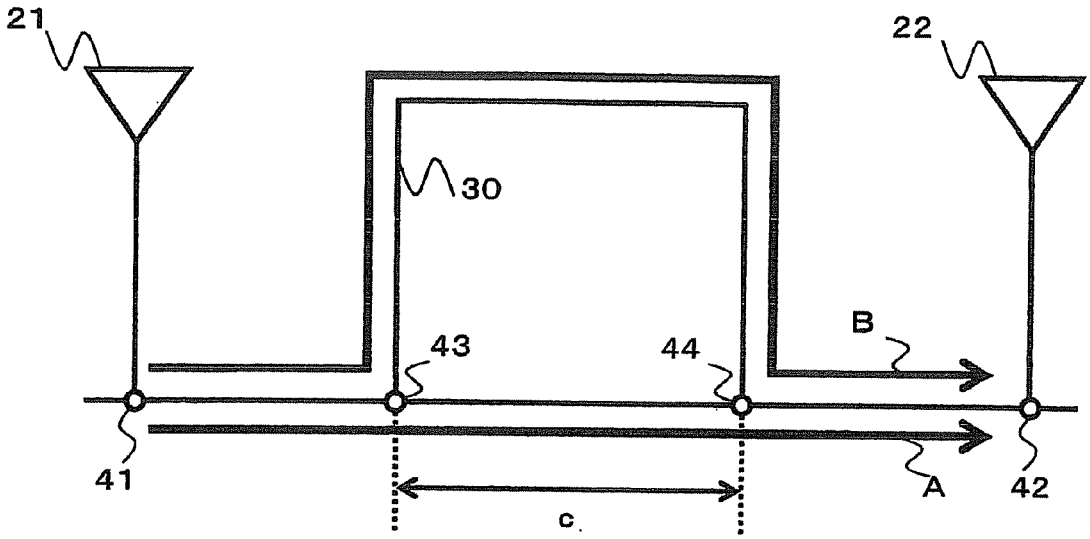
FIG. 2 is an exemplary view showing a detailed constitution of a conductive line path 33 according to the first embodiment.

Details of the conductive line path 30 will be explained in reference to FIG. 2.

A path from the connecting portion 41 of the antenna element 21 to the connecting portion 42 of the antenna element 22 without detouring through the conductive line path 30 is defined as path A. Further, a path from the connecting portion 41 to the connecting portion 42 by detouring through the conductive line path 30 is defined as path B. An element length of the conductive line path 30 is set such that a difference between respective line paths a and b of the path A and the path B become a half wavelength of a frequency of operating the antenna elements 21 and 22 (hereinafter, referred as to as operating frequency). That is, $b-a=\lambda/2$. Incidentally, notation $\lambda$ designates a length of one wavelength in the operating frequency of the antenna elements 21 and 22 and when a speed of a radio wave is designated by notation v, and the operating frequency is designated by notation f, $\lambda=v/f$.

Further, a distance c between the connecting portions 43 and 44 is shorter than a quarter wavelength of the operating frequency. This is because when the distance c is configured by the quarter wavelength, a loop of one wavelength is formed by the conductive line path 30 and the conductor base member 10 to constitute a structure easy to be resonated. When the loop of one wavelength formed by the conductive line path 30 and the conductor base member 10 is resonated, the antenna 21 and the conductive line path 30 as well as the antenna 22 and the conductive line path 30 are respectively coupled, as a result, the antenna 21 and the antenna 22 are coupled, and therefore, it is difficult to improve an isolation characteristic between the antenna 21 and the antenna 22. Further, a radio wave is radiated from the conductor line path 30. When the distance c is longer than the quarter wavelength, the conductive line path 30 is enlarged to hamper a small-sized formation of the antenna apparatus.

Next, a principle of operating the antenna apparatus of FIG. 1 will be explained. Here, although an explanation will be given of a case of improving the isolation characteristic by restraining a current flowing to the antenna element 21 from flowing to the antenna 22, even in a case in which a current flows from the antenna element 22 to the antenna element 21, the isolation characteristic can be improved by a similar principle.

First, when a radio wave is transmitted or received by the antenna element 21, the antenna element 21 is excited and a current flows. A portion of the current flowing to the antenna element 21 flows to the conductor base member 10 through the connecting portion 41. The current flowing to the conductor base member 10 is divided into a current flowing to the connecting portion 42 by passing the path B detouring through the conductive line path 30 and a current flowing to the connecting portion 42 by passing the line path A without detouring through the conductive line path 30.

As described above, the path length difference of the path A and the path B is the half wavelength of the operating frequency, and therefore, a phase difference between the current flowing to the connecting portion 42 bypassing the path A and the current flowing to the connecting portion 42 by passing the path B becomes 180 degrees at the connecting portion 42.

Therefore, the currents flowing to the connecting portion 42 are canceled by each other at the connecting portion 42 and made to be difficult to flow to the antenna element 22. Therefore, the currents flowing to the antenna 21 are made to be difficult to flow to the antenna element 22, and therefore, the isolation characteristic between the antenna element 21 and the antenna element 22 is improved.

Next, an explanation will be given of a simulation result of the antenna apparatus according to the embodiment in reference to FIG. 3. FIG. 3 illustrates diagrams for explaining the antenna apparatus used in the simulation. Further, for comparison, in addition to the antenna apparatus according to the embodiment, a simulation is carried out also for an antenna apparatus which is not provided with the conductive line path 30, and the antenna apparatus according to the background art.

FIG. 3(*a*) is a diagram showing the antenna apparatus according to the embodiment. Here, respectives of the antenna elements 21 and 22 are configured by inverse L antennas, a length between the respective connecting portions 41 and 42 of the antenna elements 21 and 22 is configured by a twelfth wavelength, a length of a portion of the conductive line path 30 orthogonal to the conductor base member 10 is configured by a quarter wavelength, and a length of a portion in parallel therewith is configured by a twenty-fourth wavelength.

FIG. 3(*b*) is a diagram showing the antenna apparatus which is not provided with the conductive line path 30. Respective constitutions thereof stay the same as those of FIG. 3(*a*) except that the conductive line path 30 is not provided.

FIG. 3(*c*) is a diagram showing the antenna apparatus according to the background art. Respective constitutions or lengths stay the same as those of FIG. 3(*a*) except that a length of a portion of a conductive line path 200 orthogonal to the conductor base member 10 is configured by eleven twenty-fourths. Therefore, a length of a loop path including the conductive line path 200 and the conductor base member 10 is configured by 1 wavelength.

FIG. 4 shows a result of the simulation. Notation 21 designates an index indicating an intensity of coupling the antenna elements 21 and 22. The index shows that smaller the value of S21, the weaker the coupling of the antenna elements 21 and 22 and the more excellent the isolation characteristic between the antenna elements 21 and 22.

As is known also from FIG. 4, S21 of the antenna apparatus according to the embodiment is −12.6 dB, S21 of the antenna apparatus shown in FIG. 3(*b*) is −6.4 dB, and S21 of the antenna apparatus shown in FIG. 3(*c*) is −7.4 dB. In this way, S21 of the antenna apparatus according to the embodiment is the smallest and the coupling is the weakest in the respective antenna apparatus. Therefore, it is known that the isolation characteristic between the antenna elements 21 and 22 is improved by providing the conductive line path 30.

As described above, according to the first embodiment, the difference of the wavelengths of the path A of the current flowing from the antenna element 21 to the antenna element 22 without detouring through the conductive line path 30 and the path B of the current flowing from the antenna element 21 to the antenna element 22 by detouring through the conductive line path 30 is the half wavelength of the operating frequency, so that the currents respectively flowing the paths A and B are canceled by each other at the connecting portions 41 and 42. Accordingly, the isolation characteristic between the antenna elements 21 and 22 can be improved.

Further, by making the distance between the connecting portions 43 and 44 of the conductive line path 30 shorter than the quarter wavelength, an unnecessary radio wave is restrained from being radiated from the conductive line path 30. A deterioration of the radiation characteristic of the antenna elements 21 and 22 can be reduced.

Further, the distance between the connecting portions 43, 44 of the conductive line path 30 is shorter than the quarter wavelength, and therefore, the conductive line path 30 is reduced and the antenna apparatus can be downsized.

Embodiment 2

Figure 5:
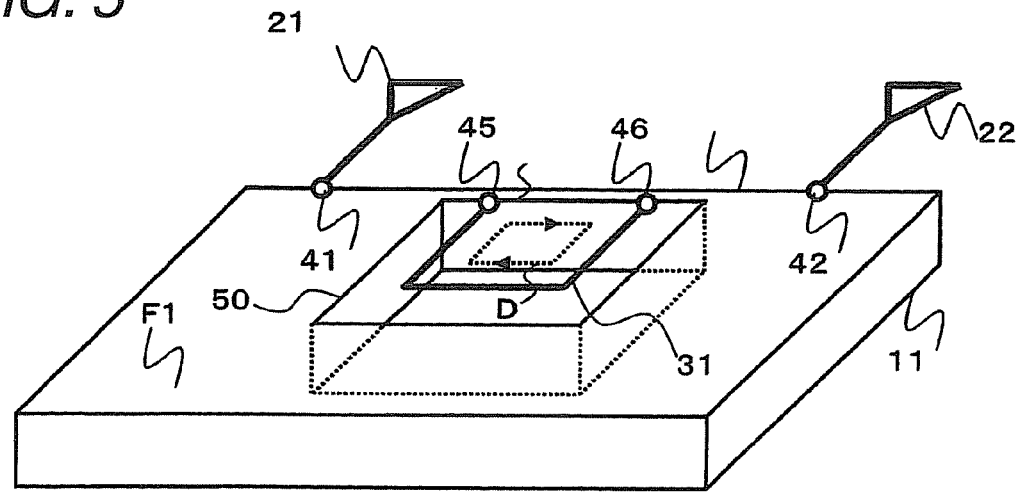
FIG. 5 is an exemplary view showing a constitution of an antenna apparatus according to a second embodiment of the invention.

A second embodiment of the invention will be explained in reference to FIG. 5. FIG. 5 is a view schematically showing an antenna apparatus according to the embodiment. According to the antenna apparatus shown in FIG. 5, the constitution and the operation principle of the antenna apparatus shown in FIG. 1 stay the same except a conductive base member 11 and a conductive line path 31, and therefore, an explanation thereof will be omitted by attaching the same notations.

The conductor base member 11 of the antenna apparatus shown in FIG. 5 includes a cutoff portion 50 between the antenna elements 21 and 22. The cutoff portion is provided such that a surrounding length of the cutoff portion 50 becomes longer than a path length of a loop path D including the conductor base member 11 of the conductive line path 31.

The conductive line path 31 is arranged at inside of the cutoff portion 50 and includes portions 45 and 46 connected with the conductor base member 11 at a side E2 substantially in parallel with a side E1 provided with the antenna elements 21, 22. An element length of the conductive line path 31 is the same as that of the conductive line path 30 shown in FIG. 1.

As described above, according to the second embodiment, by providing the conductive line path 31 at the conductor base member 11, an effect similar to that of the first embodiment is achieved, and the antenna apparatus can further be downsized since the conductive line path 31 is not projected from the conductor base member 11.

Modified Example 1

According to the embodiment, the cutoff portion 50 is provided such that the conductive line path 31 and the conductor base member 11 are not brought into contact with each other at other than the connecting portions 45 and 46.

Figure 6:
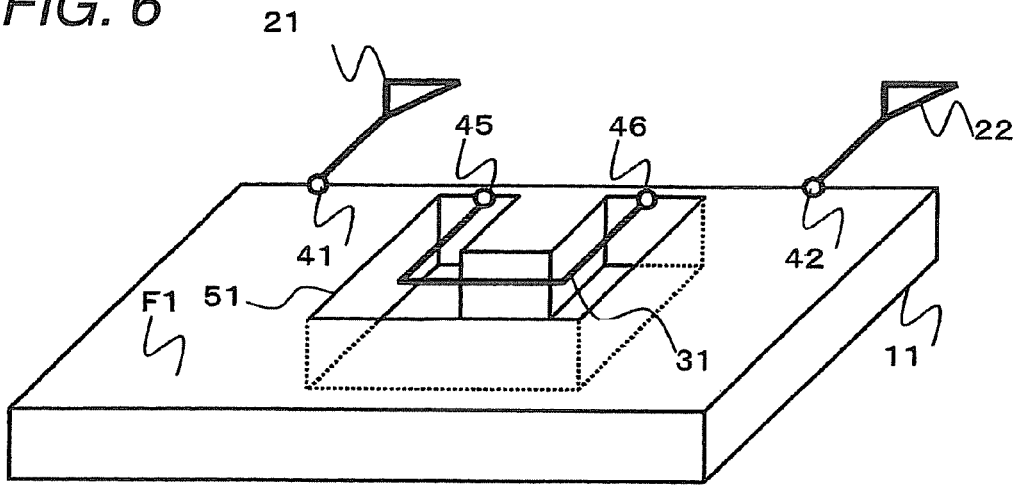
FIG. 6 is an exemplary view showing a constitution of an antenna apparatus according to modified example 1 of the second embodiment.

Therefore, the conductor base member 11 may be cut off along the conductive line path 31 as in a cutoff portion 51 of FIG. 6. In this case, an area of the cutoff portion 51 can be reduced, and therefore, strength of the conductor base member 11 can be increased.

Further, although not illustrated, an effect similar to that of the antenna apparatus shown in FIG. 5 can be achieved by providing a cutoff portion at the side E1 provided with the antenna elements 21 and 22 and shortcircuitting an open end of the cutoff portion by a line path or the like in place of the cut portions 50 and 51.

Embodiment 3

Figure 7:
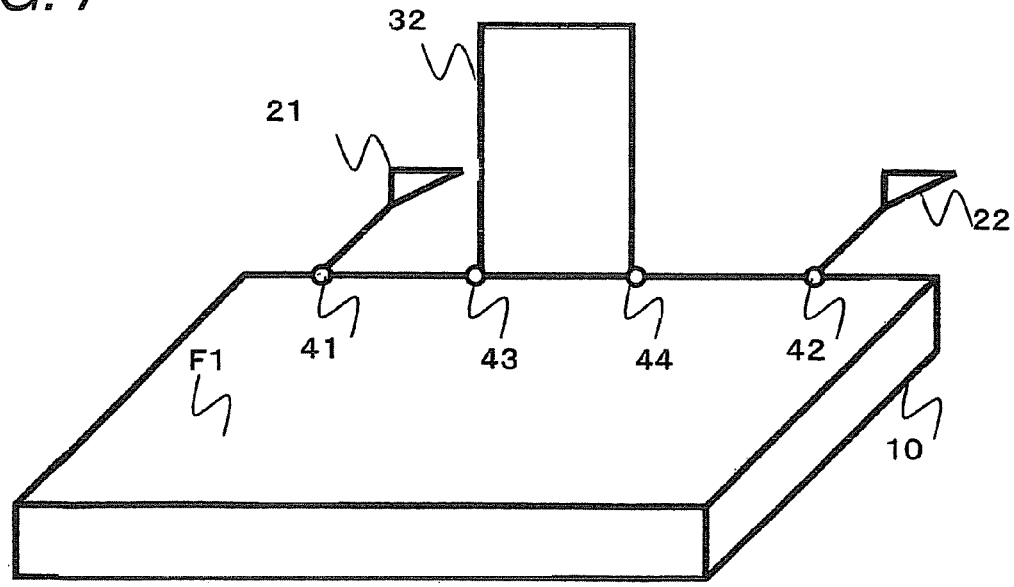
FIG. 7 is an exemplary view showing a constitution of an antenna apparatus according to a third embodiment of the invention.

A third embodiment of the invention will be explained in reference to FIG. 7 through FIG. 9. FIG. 7 is a view schematically showing an antenna apparatus according to the embodiment.

According to the antenna apparatus shown in FIG. 7, the constitution and the operation principle of the antenna apparatus shown in FIG. 1 stay the same except that a conductive line path 32 is provided substantially orthogonal to the antenna elements 21 and 22, and therefore, an explanation thereof will be omitted by attaching the same notations.

The conductive line path 32 is connected to the conductor base member 10 through the connecting portions 43 and 44 to be substantially orthogonal to the antenna elements 21 and 22. Other constitution, for example, an element length of the conductive line path 32 is the same as that of the conductive line path 30 of FIG. 1. Further, according to the antenna apparatus shown in FIG. 7, the antenna elements 21 and 22 are arranged in parallel with the face F1 of the conductor base member 11, and therefore, the face F1 and the conductive line path 32 are substantially orthogonal to each other.

A simulation is carried out by using the antenna apparatus shown in FIG. 8. According to the antenna apparatus shown in FIG. 8, lengths and arrangements of respective elements and the like are the same as those of the antenna apparatus shown in FIG. 3(*a*) except that the conductive line path 32 and the antenna elements 21 and 22 are orthogonal to each other.

FIG. 9 shows a simulation result. Further, also the simulation result of the antenna apparatus shown in FIG. 3(*b*) is shown in FIG. 9. According to the antenna apparatus of the embodiment, S21 is −10.9 dB and the isolation characteristic is improved more than the antenna apparatus shown in FIG. 3(*b*) even by 4.5 dB.

As described above, according to the third embodiment, by providing the conductive line path 32 to the conductor base member 10, the isolation characteristic can be improved in comparison with the antenna apparatus which is not provided with the conductive line path 32 similar to the first embodiment. Further, by arranging the conductive line path 32 to be substantially orthogonal to the antenna elements 21 and 22, an influence of a radio wave radiated by making a current flow in the conductive line path 32 is made to be difficult to be effected. Therefore, a deterioration in the radiation characteristic of the antenna elements 21, 22 can further be restrained.

Embodiment 4

A fourth embodiment of the invention will be explained in reference to FIG. 10 and FIG. 11. FIG. 10 is a view schematically showing an antenna apparatus according to the embodiment. According to the antenna apparatus shown in FIG. 10, the constitution and the operation principle of the antenna apparatus shown in FIG. 1 stay the same except a shape of a conductive line path 33, and therefore, an explanation thereof will be omitted by attaching the same notations.

The conductive line path 33 includes linear elements 331 and 332 extended substantially orthogonal to the face F1 of the conductor base member 10 and a linear element 333 substantially in parallel with the face F1.

One ends of the linear elements 331 and 332 are brought into contact with the conductor base member 10 respectively at the connecting portions 43 and 44 and other ends thereof are respectively connected to both ends of the linear elements 333. Further, the linear element 333 is configured by a channel-like shape folded to bend substantially by a right angle at two portions thereof.

Further, according to the antenna apparatus shown in FIG. 10, the antennal elements 21 and 22 are arranged substantially in parallel with the face F1, and therefore, the antenna elements 21 and 22 and the linear elements 331 and 332 are substantially orthogonal to each other.

Other constitution, for example, the element length of the conductive line path 33 is the same as that of the antenna apparatus shown in FIG. 1.

Figure 11A:
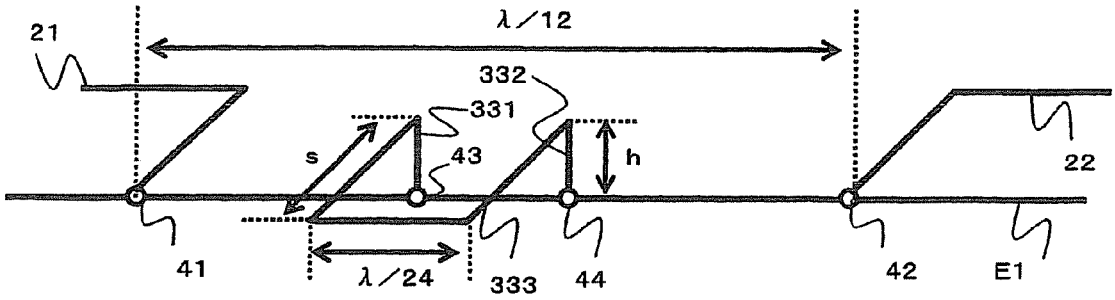
FIG. 11 exemplary illustrates diagrams showing a simulation according to the fourth embodiment.
Figure 11B:
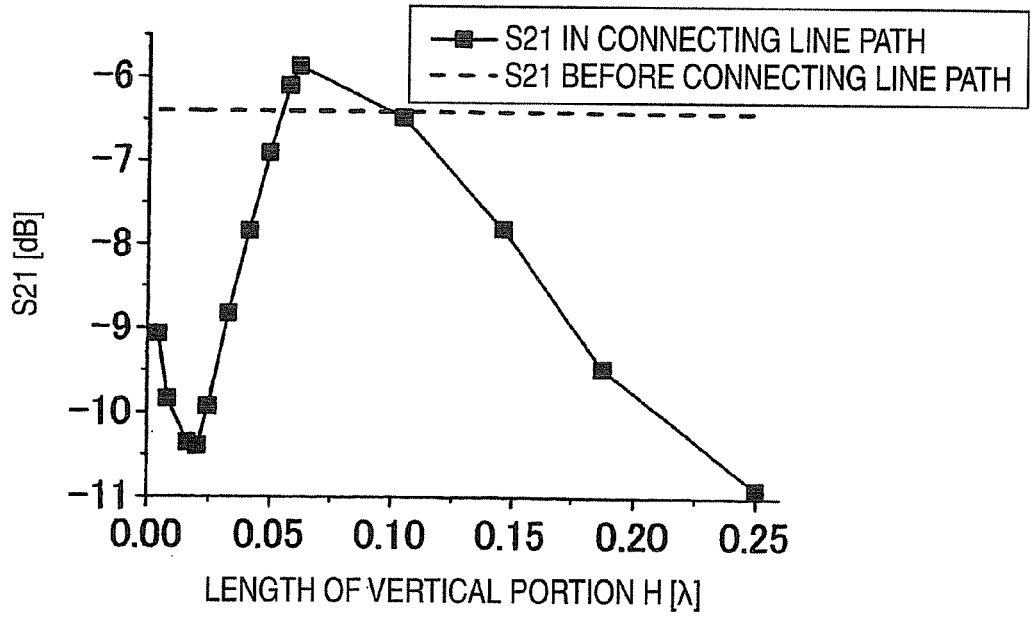

A simulation is carried out by using the antenna apparatus shown in FIG. 11(*a*). Lengths, arrangements and the like of respective elements of the antenna apparatus shown in FIG. 11(*a*) are the same as those of the antenna apparatus shown in FIG. 3(*a*) except that the shape of the conductive line path 33. Here, an element length of the linear elements 331 and 332 are designated by notation h, a length of a portion of the linear element 333 substantially orthogonal to the side E1 of the conductor base member 10 is designated by notation s, and the simulation is carried out by changing values of hands. Further, $s+h=\lambda/4$ (constant).

FIG. 11(*b*) shows a simulation result. As is known from FIG. 11(*b*), in comparison with the antenna apparatus before installing the conductive line path 33 (refer to FIG. 3(*b*)), according to the antenna apparatus shown in FIG. 11(*a*), S21 becomes a low value in ranges of $h \leqq \lambda/20$, $h \geqq \lambda/10$.

Further, although in a range of $\lambda/20<h<\lambda/10$, S21 of the antenna apparatus shown in FIG. 11(*a*) becomes higher than S21 of the antenna apparatus shown in FIG. 3(*a*), this is conceived because an impedance value of the conductive line path 33 is changed by folding to bend the line path. That is, it is conceived that in the range of $\lambda/20<h<\lambda/10$, the impedance value of the conductive line path 33 become high and currents flowing in the conductor base member 10 are made to be difficult to flow to the conductive line path 33, and therefore, the currents are made to be difficult to be canceled by each other.

As described above, according to the antenna apparatus of the fourth embodiment, an effect of improving the isolation characteristic between the antenna elements 21 and 22 is achieved similar to the first embodiment by constituting the element length h of the linear elements 331 and 332 of the conductive line path 33 by $h \leqq \lambda/20$, $h \geqq \lambda/10$. Further, the conductive line path 33 and the antenna apparatus 21 and 22 are arranged to be remote from each other spatially, and therefore, the antenna elements 21 and 22 are made to be difficult to be effected with an influence by currents flowing in the conductive line path 33. Further, the antenna apparatus can further be downsized since the conductive line path 33 is not projected from the conductor base member 10.

Modified Example 2

A shape of the conductor line path 33 is arbitrary when the conductor line path 33 is not connected to the conductor base member 10 at other than the connecting portion 43 and 44. For example, as shown by FIG. 12, the linear element 333 may be configured by a shape folded to bend by a plurality of times.

Figure 12:
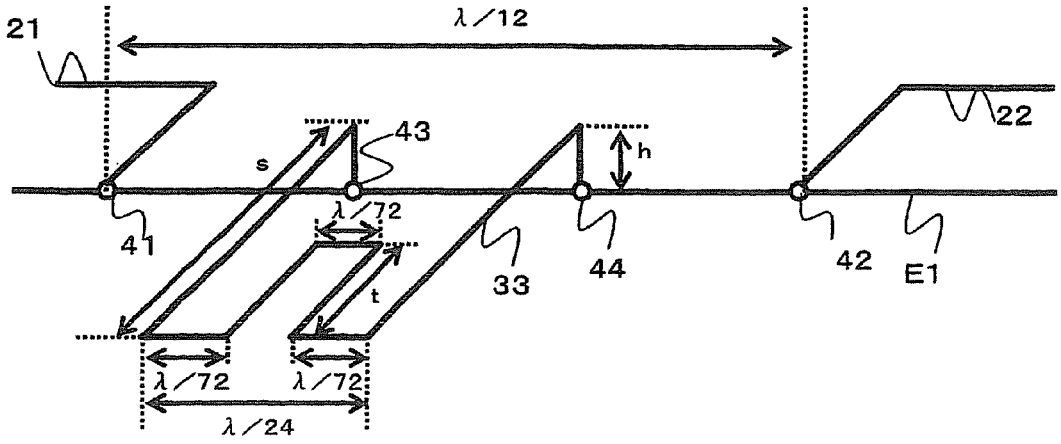
FIG. 12 is an exemplary view showing a constitution of an antenna apparatus according to modified example 2 of the fourth embodiment.

According to the antenna apparatus shown in FIG. 12, the linear element 333 is folded to bend by 4 times and the conductive line path 33 is configured by a recessed shape.

A simulation is carried out by using the antenna apparatus of FIG. 12. A total of lengths of portions in parallel with the side E1 is (1/72×3)=one twenty-fourth wavelength. Further, lengths of portions orthogonal to the side E1 is h=one fiftieth wavelength, s=eight fiftieths wavelength, t=nine hundredth wavelength, and a total h+s+t becomes a quarter wavelength. The other constitution is the same as the antenna apparatus shown in FIG. 1.

As a result of the simulation, S21 of the antenna apparatus shown in FIG. 12 has been −10.9 dB. This is smaller by 4.5 dB in comparison with S21 (−6.4 dB) of the antenna apparatus shown in FIG. 3(*b*).

In this way, an effect similar to that of the fourth embodiment is achieved even when the shape of the conductive line path 33 is changed. Further, a size of the conductive line path 33 can be reduced, and therefore, the antenna apparatus can be downsized. Further, the modified example may be applied to the antenna apparatus shown in the first through the fourth embodiments.

Modified Example 3

Figure 13:
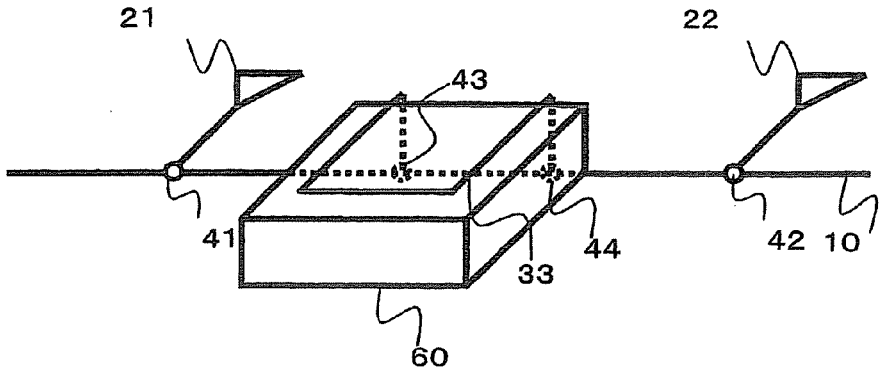
FIG. 13 is an exemplary view showing a constitution of an antenna apparatus according to modified example 3 of the fourth embodiment.

Further, an antenna apparatus according to a modified example 3 shown in FIG. 13 includes a dielectric layer 60 between the conductive line path 33 and the conductor base member 10. In this way, the element length of the conductive line path 33 can be shortened by providing the dielectric layer 60 on the conductor base member 10 and arranging the conductive line path 33 at a surface of the dielectric layer. Further, the dielectric layer 60 is arranged to support the conductive line path 33, and therefore, the conductive line path 33 is fixed to the dielectric layer 60 and even when an impact or the like is applied to the antenna apparatus, a shape of the conductive line path 33 is made to be difficult to be changed.

Modified Example 4

Figure 14:
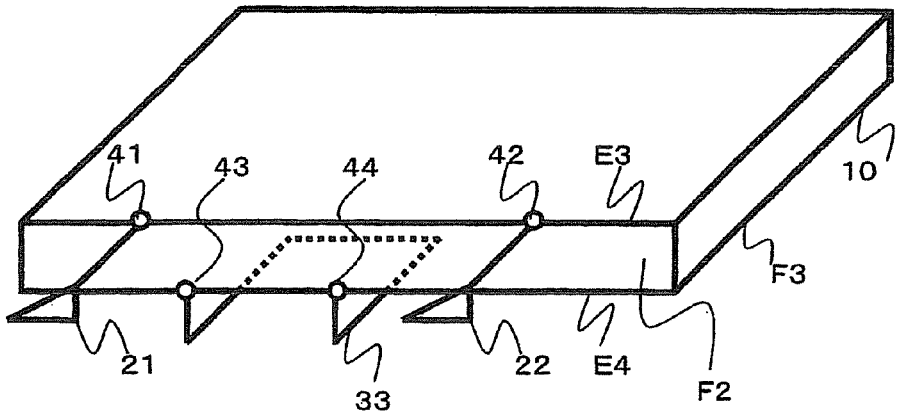
FIG. 14 is an exemplary view showing a constitution of an antenna apparatus according to modified example 4 of the invention.

According to the antenna apparatus of a modified example 4 shown in FIG. 14, the antenna elements 21 and 22 are arranged at a side E3 of a face F2 of the conductor base member 10. Further, the conductive line path 33 is arranged at one side E4 in parallel with the side E3 of the face F2. The other constitution is the same as that of the antenna apparatus shown in FIG. 10.

Further, the sides E3 and E4 of the conductor base member are electrically conducted. According thereto, for example, the face of F2 may be configured by a conductive metal layer similar to the face F1 shown in FIG. 1, and the face F3 in parallel with the face F1 and the face F1 may be conducted by using a through hole or the like.

In this way, by providing the antenna elements 21 and 22 and the conductive line path 33 at difference sides E3 and E4 of the same plane F2, distances between the antenna elements 21 and 22 and the conductive line path 33 can be widened. Further, the conductor base member 10 shields a radio wave radiated from the conductive line path 33. Therefore, the antenna element 21 and 22 are made to be difficult to be effected with an influence by a current flowing in the conductive path 33 and a deterioration in the radiation characteristic of the antenna elements 21 and 22 can further be restrained.

Embodiment 5

Figure 15:
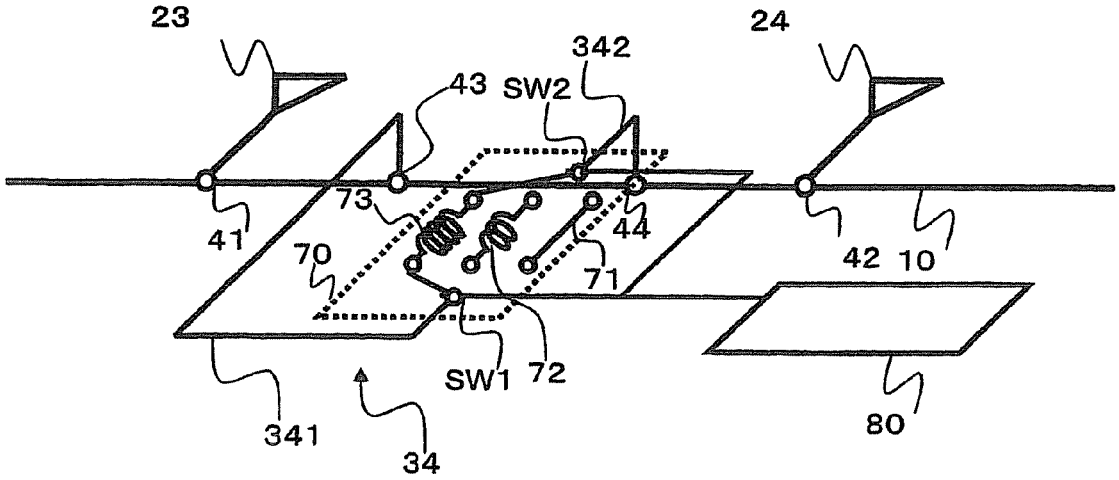
FIG. 15 is an exemplary view showing a constitution of an antenna apparatus according to a fifth embodiment of the invention.

A fifth embodiment of the invention will be explained in reference to FIG. 15. FIG. 15 is a view schematically showing an antenna apparatus according to the embodiment. According to the embodiment, an explanation will be given of an antenna apparatus capable of transmitting and receiving signals having a plurality of frequencies. Here, an explanation will be given of a case in which the antenna elements 23 and 24 are wide band antenna elements.

According to the antenna apparatus shown in FIG. 15, the constitution and the operation principle of the antenna apparatus shown in FIG. 10 is the same except that a switching circuit 70 is provided at a middle of a conductive line path 34 and the switching circuit 70 is controlled by a control circuit 80.

The conductive line path 34 includes linear elements 341 and 342 one ends of which are connected to the conductor base member 10 and other ends of which are connected to the switching circuit 70.

The switching circuit 70 includes a shortcircuit element 71, coil-like elements 72, 73 having different element lengths, and switches SW1 and SW2 for switching the respective elements 71 through 73. By switching the switches SW1 and SW2, respective elements of the linear elements 341 and 342 are connected through any of the shortcircuit element 71 and the coil-like elements 72 and 73.

The control circuit 80 switches the elements 71 through 73 for connecting the linear elements 341 and 342 by controlling the switches SW1 and SW2 of the switching circuit 70. The control circuit 80 acquires a frequency used for transmitting and receiving a signal to and from a wireless circuit (not illustrated) (hereinafter, referred to as acquired frequency). Next, the control circuit 80 selects the elements 71 through 73 such that a path difference between a path from the connecting portion 43 of the antenna element 23 to the connecting portion 44 of the antenna element 24 without detouring through the conductive line path 34 and a path from the connecting portion 43 of the antenna element 23 to the connecting portion 44 of the antenna element 24 becomes a half wavelength of the acquired frequency. Next, the control circuit 80 controls the switches SW1 and SW2 such that the selected element is connected to the linear elements 341 and 342.

As described above, according to the fifth embodiment, by providing the conductive line path 34 at the conductor base member 10, an effect similar to that of the fourth embodiment is achieved and even when the antenna apparatus transmits and receives signals of difference frequencies, the isolation characteristic of the antenna elements 23 and 24 can be improved in accordance with the frequency used and a deterioration in a radiation efficiency can be restrained. Therefore, the antenna apparatus according to the fifth embodiment can be mounted to a wiring machine using a plurality of frequency bands.

Further, although according to the embodiment, an explanation has been given of a case in which the antenna elements 23 and 24 are the wide band antenna elements, the same goes also with a case in which the antenna elements 23 and 24 transmit and receive signals of frequencies different from each other. In this case, the switching circuit 70 is controlled in accordance with an operating frequency of the antenna element used for transmission and reception.

Modified Example 5

Figure 16:
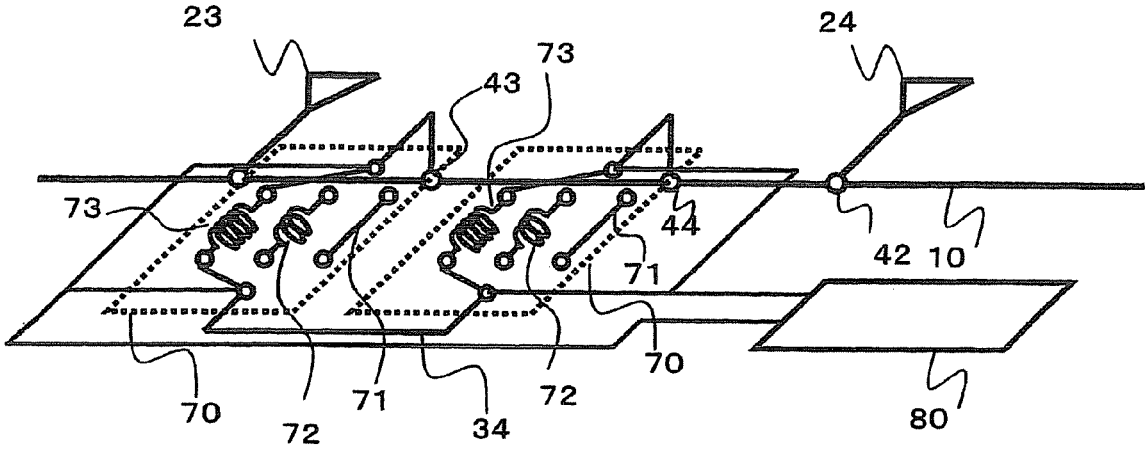
FIG. 16 is an exemplary view showing a constitution of an antenna apparatus according to modified example 5 of the fifth embodiment.

As shown by FIG. 16, a plurality of the switching circuits 70 can also be arranged at a middle of the conductive line path 34. Other constitution and the operating principle are the same as those of the antenna apparatus shown in FIG. 15.

By providing the plurality of switching circuits 70, a signal having a wider frequency band can be dealt with. Further, a width of selecting the elements 71 through 73 is widened, and therefore, the element length of the conductive line path 34 can finely be adjusted.

Although according to the embodiment and modified example 5, an example of installing the switching circuit 70 to the antenna apparatus shown in FIG. 10 is shown, the example may be applied to other antenna apparatus. For example, as shown by FIG. 13, by providing the switching circuit 70 to the antenna apparatus including the dielectric layer 60 between the conductor base member 10 and the conductive line path 33, the switching circuit 70 can be provided without being electrically connected to the conductor base member 10.

Embodiment 6

Figure 17:
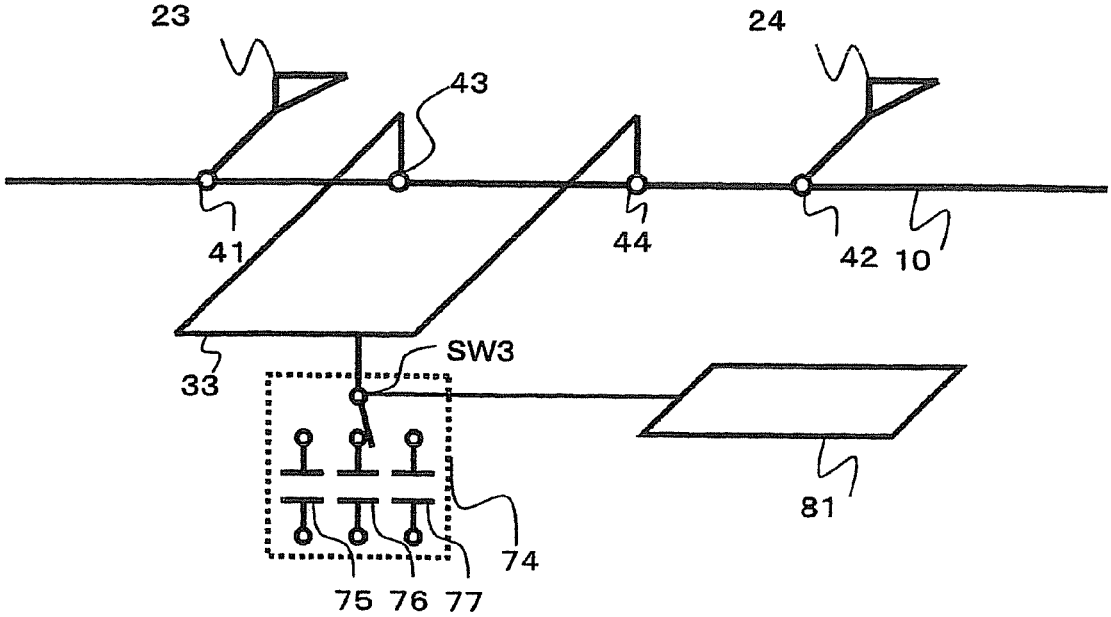
FIG. 17 is an exemplary view showing a constitution of an antenna apparatus according to a sixth embodiment of the invention.

Next, a sixth embodiment of the invention will be explained in reference to FIG. 17. FIG. 17 is a view schematically showing an antenna apparatus according to the embodiment. According to the antenna apparatus of the embodiment, an electric element length of the conductive line path 30 is changed by using capacitors in place of the coil-like elements 72 and 73. Therefore, the constitution and the operation principle of the antenna apparatus shown in FIG. 17 stay the same except that a switching circuit 74 having capacitors 75 through 77 is provided and the antenna elements 23 and 24 are wide band antenna elements, and therefore, an explanation thereof will be omitted by attaching the same notations.

The switching circuit 74 includes a plurality of capacitors 75 through 77 having different capacitance values and a switch SW3 for switching connection between the respective capacitors 75 through 77 and the conductive line path 33. One end of the switch SW3 is connected the conductive line path 33 and other end thereof is connected to any one of the capacitors 75 through 77. Other ends of the capacitors 75 through 77 are connected to the conductor base member 10. That is, by switching the switch SW3 of the switching circuit 74, the conductive line path 33 is connected to the conductor base member 10 through any of the capacitors 75 through 77.

A control circuit 81 switches the capacitors 75 through 77 connected to the conductive path 33 and the conductor base member 10 by controlling the switch SW3 of the switching circuit 74. The control circuit 81 acquires a frequency used for transmitting and receiving a signal from a wireless circuit (not illustrated). Next, the capacitors 75 through 77 are selected such that a path difference of a path from the connecting portion 43 of the antenna element 23 to the connecting portion 44 of the antenna element 24 without detouring through the conductive line path 34 and a path from the connecting portion 43 of the antenna element 23 to the connecting portion 24 of the antenna element 24 by detouring through the conductive line path 34 becomes a half wavelength of the acquired frequency. Next, the control circuit 81 controls the switch SW3 such that the selected capacitor is connected to the conductive line path 33 and the conductor base member 10.

When the capacitors 75 through 77 connected to the conductive line path 33 are switched by being controlled by the control circuit 81, the impedance value of the conductive line path 33 is changed. Thereby, the electric element length of the conductive line path 33 is changed.

As described above, according to the fifth embodiment, by providing the conductive line path 33 at the character base member 10, an effect similar to that of the fourth embodiment is achieved, by switching the capacitors 75 through 77 in accordance with the acquired frequency, the electric element length of the conductive line path 33 can be changed, and even when signals having different frequencies are transmitted and received, the isolation characteristic of the antenna elements 23 and 24 can be improved and a deterioration in the radiation efficiency can be restrained.

Modified Example 6

Figure 18:
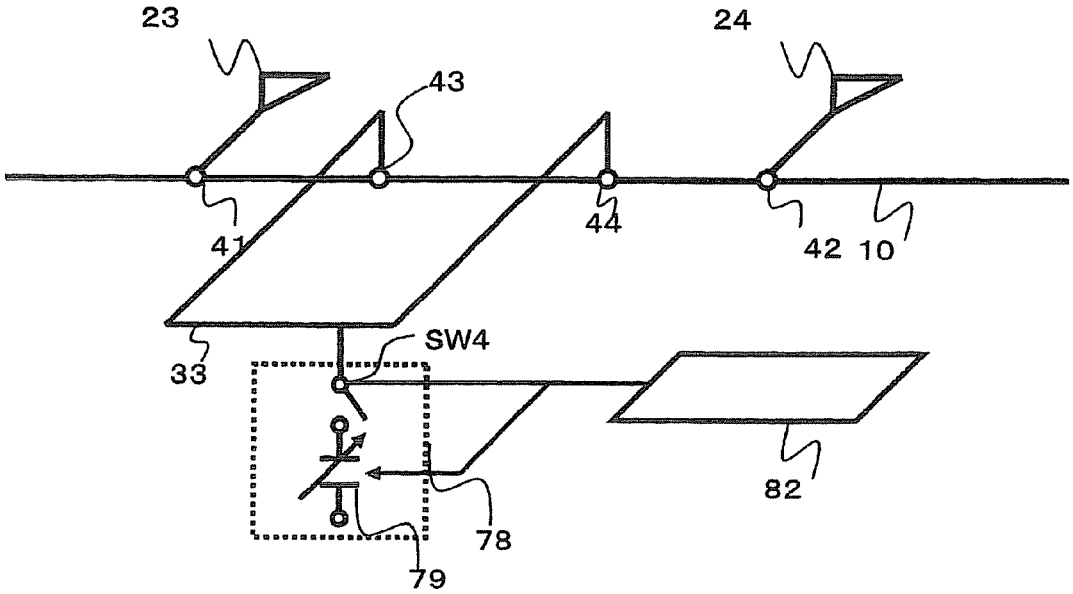
FIG. 18 is an exemplary view showing a constitution of an antenna apparatus according to modified example 6 of the sixth embodiment.

As shown by FIG. 18, as the switching circuit 78, a variable capacitance element 79 may be used in place of the capacitors 75 through 77 having different capacitance values. In this case, one end of the variable capacitance element 79 is connected to the conductor base member 10 and other end thereof is connected to the conductive line path 33 through the switch SW4.

When the control circuit 82 acquires a frequency used for transmitting and receiving a signal from a wireless circuit (not illustrated), next, the control circuit 82 controls ON/OFF of the switch SW4 such that a path difference of a path from the connecting portion 43 of the antenna element 23 to the connecting portion 44 of the antenna element 24 without detouring through the conductive line path 34 and a path from the connecting portion 43 of the antenna element 23 to the connecting portion 44 of the antenna element 24 by detouring through the conductive line path 34 becomes a half wavelength of the acquired frequency.

Although when the switch SW4 is made OFF, a processing is finished thereby, when the switch SW4 is made ON, the control circuit 82 controls an impedance value of the variable capacitance element 79 such that the above-described path difference becomes the half wavelength of the acquired frequency.

In this way, even when the variable capacitance element 79 is used in place of the plurality of capacitors 75 through 77, an effect similar to that of the antenna apparatus shown in FIG. 17 is achieved. Further, by using the variable capacitance element 79, a circuit scale can be reduced and the electric element length of the conductive line path 33 can finely be adjusted.

Although here, an example of installing the switching circuits 74 and 78 to the antenna apparatus shown in FIG. 10 is shown, the switching circuits 74 and 78 may be installed to other antenna apparatus. Further, similar to modified example 5, a plurality of the switching circuits 74 and 78 may be installed.

Modified Example 7

Figure 19:
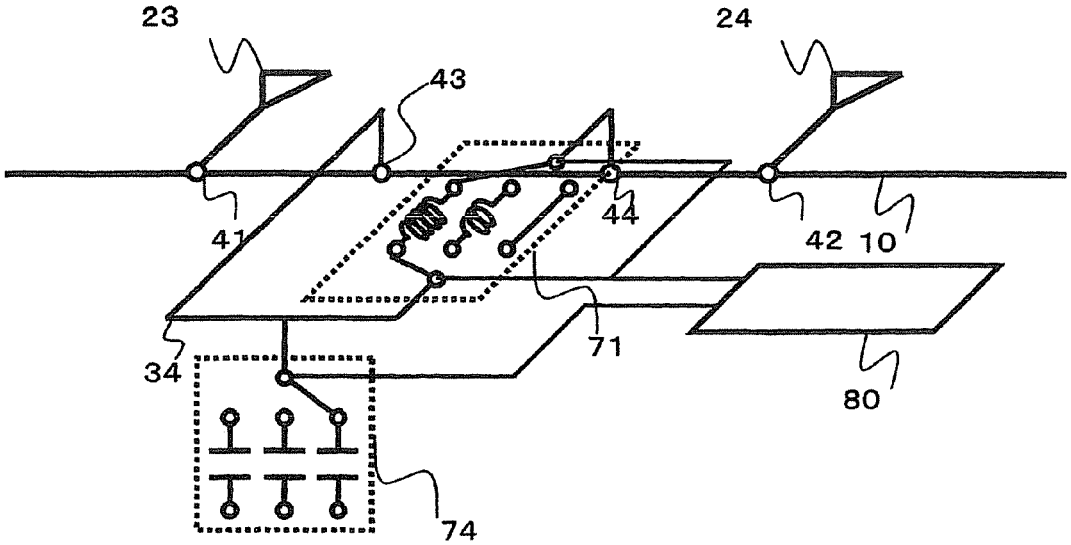
FIG. 19 is an exemplary view showing a constitution of an antenna apparatus according to modified example 7 of the sixth embodiment.

Further, as shown by FIG. 19, the switching circuits 70 and 74 may also be installed to the antenna apparatus shown in FIG. 10. In this case, physical and electric element lengths of the conductive line path 74 can be changed in accordance with acquired frequency.

Embodiment 7

Figure 20:
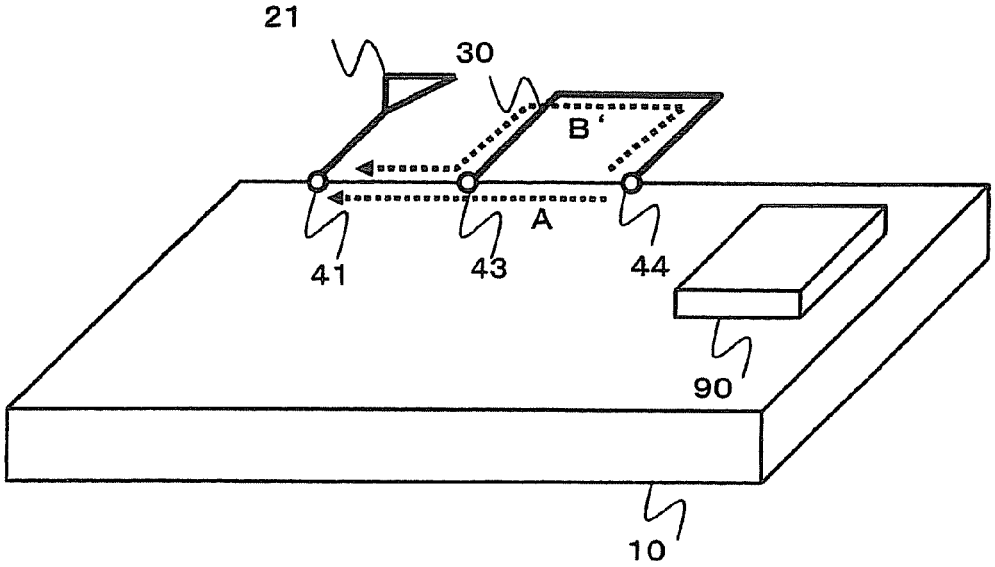
FIG. 20 is an exemplary view showing a constitution of an antenna apparatus according to a seventh embodiment of the invention.

A seventh embodiment of the invention will be explained in reference to FIG. 20. According to the antenna apparatus shown in FIG. 20, the constitution and the operation principle of the antenna apparatus shown in FIG. 1 is the same except that a signal processing circuit 90 is provided in place of the antenna element 22, and therefore, an explanation thereof will be omitted by attaching the same notations.

The signal processing circuit 90 is arranged at a vicinity of the antenna element 21 of, for example, a wireless device, CPU, a driver of a display, a television receiver or the like.

When the signal processing circuit 90 is provided at the vicinity of the antenna element 21 in this way, a current flows out from the signal processing circuit 90 to the conductor base member 10 and a strong current flows along a side of the conductor base member 10. A radiation characteristic of the antenna element 21 is deteriorated by making the current flow to the antenna element 21. Hence, according to the antenna apparatus shown in the embodiment, the conductive line path 30 is provided between the antenna element 21 and the signal processing circuit 90, and currents flowing at the conductive base member 10 are made to be canceled by each other by an operation principle similar to that of the antenna apparatus shown in FIG. 1.

However, it is unknown from where of the signal processing circuit 90 the current flowing out from the signal processing circuit 90 specifically flows out. However, the current flowing to the conductor base member 10 can be made to be difficult to flow to the antenna element 21 by setting the element length of the conductive line path 30 such that a path difference of a length of a path A' connecting the antenna element 21 and the connecting portion 44 without detouring through the conductive line path 30 and a length of a path B' connecting the antenna element 21 and the connecting portion 44 by detouring through the conductive line path 30 becomes the half wavelength of the operating frequency of the antenna element 21. This is because the current flowing out from the signal processing circuit 90 flows to the connecting portion 44 by passing one path.

Further, when a frequency of the current flowing out from the signal processing circuit 90 effects an adverse influence on operation of the antenna element 21, the path difference of the paths A' and B' may be configured by a half wavelength of the frequency.

As described above, according to the seventh embodiment, the deterioration in the radiation characteristic of the antenna element 21 can be reduced by improving the isolation characteristic between the signal processing circuit 90 and the antenna element 21.

Embodiment 8

Figure 21:
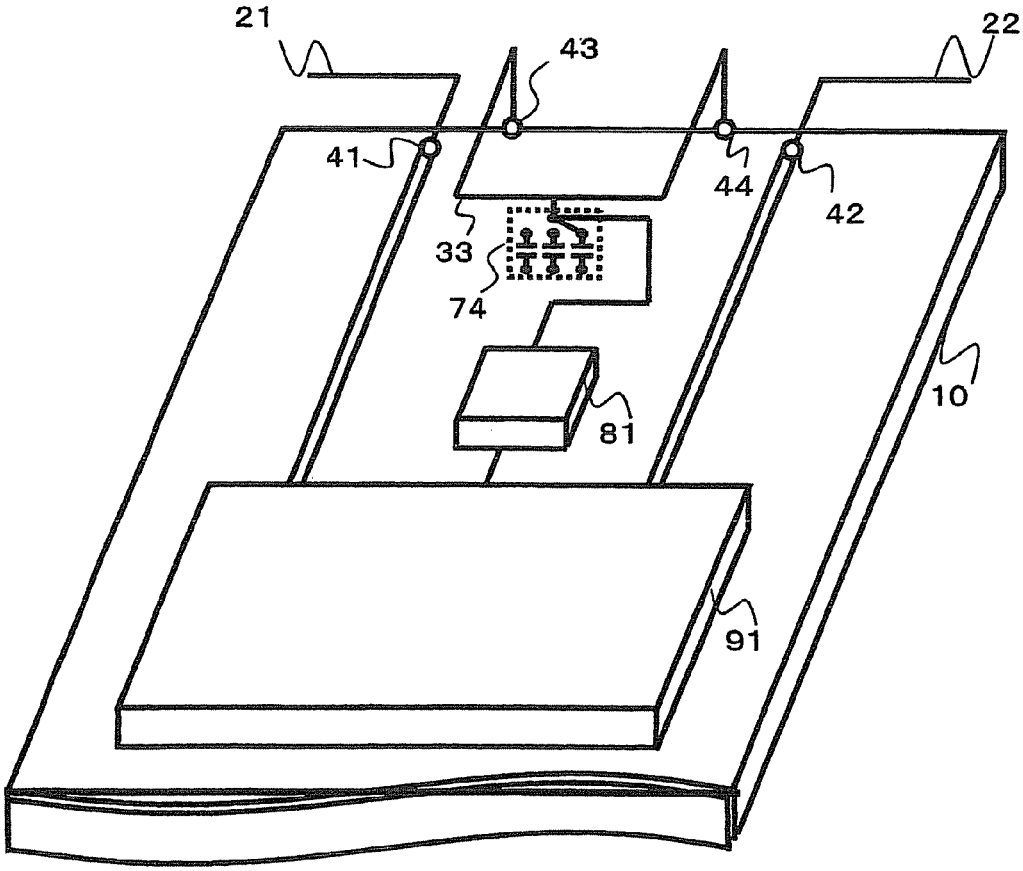
FIG. 21 is a view showing a constitution of an antenna apparatus according to an eighth embodiment of the invention.

Next, an eighth embodiment of the invention will be explained in reference to FIG. 21. As shown by FIG. 21, according to the embodiment, an example of mounting the antenna apparatus shown in FIG. 17 to a wireless device is shown.

The wireless device according to the embodiment includes a wireless circuit 91 connected to the antenna apparatus shown in FIG. 17 through the antennas 23 and 24 and power feed lines 35 and 36.

An explanation will be given of a case of transmitting a signal by the wireless device.

First, the wireless device 91 generates a wireless signal. The control circuit 81 acquires a frequency used when the wireless signal is transmitted from the wireless circuit 91.

Next, the control circuit 81 controls the switching circuit 74 such that the path difference between the path from the connecting portion 43 of the antenna element 23 to the connecting portion 44 of the antenna element 24 without detouring through the conductive line path 34 and the path from the connecting portion 43 of the antenna element 23 to the connecting portion 44 of the antenna element 24 by detouring through the conductive line path 34 becomes the half wavelength of the acquired frequency. The wireless circuit 91 transmits the wireless signal through the antenna elements 23 and 24.

On the other hand, when the wireless device receives a signal, the control circuit 81 acquires a frequency used when the wireless signal is received from the wireless circuit 91. The control circuit 81 controls the switching circuit 74 such that the path difference between the path from the connecting portion 43 of the antenna element 23 to the connecting portion 44 of the antenna element 24 without detouring through the conductive line path 34 and the path from the connecting portion 43 of the antenna element 23 to the connecting portion 44 of the antenna element 24 by detouring through the conductive line path 34 becomes the half wavelength of the acquired frequency. The wireless circuit 91 receives the wireless signal through the antenna elements 23 and 24 and carries out a signal processing for the received wireless signal.

As described above, according to the eighth embodiment, by mounting the antenna apparatus of FIG. 17 to the wireless device, the isolation characteristic of the antenna elements 23 and 24 can be improved and a deterioration in the radiation characteristic can be restrained. Therefore, the wireless device according to the embodiment can excellently transmit and receive a signal.

Although here, an explanation has been given of the case of mounting the antenna apparatus of FIG. 17 to the wireless device, a similar effect is achieved even when other antenna apparatus is mounted to the wireless device.

Further, although according to the above-described antenna apparatus, a number of the antenna elements is 2 pieces, the number of the antenna elements is not limited thereto but may be 2 pieces or more. In this case, by providing the conductive line path between the respective antenna elements, the isolation characteristic between the antenna elements adjacent to each other by interposing the conductive line path can be improved and the deterioration in the radiation characteristic can be restrained.

According to the above-described embodiments, a small-sized antenna apparatus and a wireless device improving an isolation characteristic between antennas and restraining a deterioration in a radiation characteristic of the antennas can be provided.

Further, the invention is not limited to the above-described embodiments as they are but can be embodied by modifying constituent elements thereof within the range not deviated from the gist at an embodying stage. Further, various inventions can be formed by pertinently combining a plurality of constituent elements disclosed in the above-described embodiments. For example, a number of constituent elements may be deleted from all the constituent elements shown in the embodiments. Further, constituent elements over different embodiments may pertinently be combined.

What is claimed is:

1. An antenna apparatus comprising:

a substrate comprising an end portion;

a plurality of antenna elements connected to the end portion of the substrate through a connecting portion; and a conductive line path provided between two adjacent antenna elements of the plurality of antenna elements, both ends of the conductive line path connected to the end portion of the substrate;

wherein a distance between both ends of the conductive line path is shorter than a quarter wavelength of an operating frequency of the plurality of antenna elements, and wherein a path difference between a first path length defined from the connecting portion of one of the two adjacent antenna elements to the connecting portion of the other of the two adjacent antenna elements through both ends portion of the conductive line path and a second path length defined from the connecting portion of one of the two adjacent antenna elements to the connecting portion of the other of the two adjacent antenna elements through the conductive line path is a half wavelength of the operating frequency.

2. The antenna apparatus according to claim 1, wherein the substrate includes a cut-off portion, and wherein the conductive line path is arranged at inside of the cutoff portion.

3. The antenna apparatus according to claim 1, wherein an antenna element of the plurality of antenna elements comprises a linear portion, and wherein the conductive line path is arranged to be substantially orthogonal to the linear portion of the antenna element of the plurality of antenna elements.

4. The antenna apparatus according to claim 1, wherein the conductive line path includes:

two first conductive lines respective one ends of which are connected to the end portion of the substrate and which are substantially orthogonal to a face of the substrate; and a second conductive line both ends of which are respectively connected to respective other ends of the first conductive lines and substantially in parallel with the face of the substrate;

wherein an element length of the first conductive line is shorter than a twentieth wavelength and longer than a tenth wavelength.

5. The antenna apparatus according to claim 4, comprising:

a dielectric layer arranged on the substrate, wherein the conductive line path is arranged at a surface of the dielectric layer.

6. The antenna apparatus according to claim 1, comprising:

a switching unit configured to switch an electric element length of the conductive line path; and a controlling unit configured to control the switching unit in accordance with a signal transmitted and received through an antenna element of the plurality of antenna elements, wherein the controlling unit controls the switching unit to switch an electric element length of the conductive line path so as to make the path difference a half wavelength of a frequency of the signal.

7. The antenna apparatus according to claim 6, wherein the conductive line path includes two of third conductive lines one ends of which are connected to the end portion of the substrate and other ends of which are connected to the switching unit; and wherein the switching unit includes a plurality of linear elements respectively having different electric element lengths and a switch for respectively connecting one of both ends of the plurality of linear elements and respective other ends of the two third conductive lines based on a control of the controlling unit.

8. The antenna apparatus according to claim 6, wherein the switching unit connects a plurality of capacity elements respective one ends of which are connected to the substrate and capacitance values of which differ from each other and one of the plurality of capacitance elements and the conductive line path based on a control of the controlling unit.

9. The antenna apparatus according to claim 6, wherein the switching unit includes:

a variable capacitance element one of which is connected to the substrate; and a switch configured to switch connection/cutting of the variable capacitance element and the conductive line path based on a control of the controlling unit, and wherein the controlling unit changes the electric element length of the conductive line path by controlling connection/cutting of the switch and a capacitance value of the variable capacitance element.

10. An antenna apparatus comprising:

a substrate comprising an end portion;

an antenna element connected to the end portion of the substrate through a connecting portion;

a circuit portion arranged on the substrate for carrying out a signal processing; and a conductive line path provided between the antenna element and the circuit portion, both ends of the conductive line path connected to the end portion of the substrate;

wherein a distance between both ends of the conductive line path is shorter than a quarter wavelength of an operating frequency of the antenna element; and wherein a first path is defined by a path from one end of the conductive line path connected to the substrate which is further from the antenna element than the other end of the conductive line path connected to the substrate to the connecting portion through the end portion of the substrate, wherein a second path is defined by a path from the one end of the conductive line path to the connecting portion through the conductive line path, and wherein a path length difference of the first path and the second path becomes either one of a half wavelength of the operating frequency and a frequency of a signal to which the circuit portion carries out the signal processing.

11. A wireless device comprising:

an antenna apparatus includes;

a substrate comprising an end portion;

a plurality of antenna elements connected to the end portion of the substrate through a connecting portion; and a conductive line path provided between two adjacent antenna elements of the plurality of antenna elements, both ends of the conductive line path connected to the end portion of the substrate;

wherein a distance between both ends of the conductive line path is shorter than a quarter wavelength of an operating frequency of the plurality of antenna elements, and wherein a path difference between a first path length defined from the connecting portion of one of the two adjacent antenna elements to the connecting portion of the other of the two adjacent antenna elements through both ends of the conductive line path and a second path length defined from the connecting portion of one of the two adjacent antenna elements to the connecting portion of the other of the two adjacent antenna elements through the conductive line path is a half wavelength of the operating frequency.

12. The wireless device according to claim 11, wherein the substrate includes a cut-off portion, and wherein the conductive line path is arranged at inside of the cutoff portion.

13. The wireless device according to claim 11, wherein an antenna element of the plurality of antenna elements comprises a linear portion, and wherein the conductive line path is arranged to be substantially orthogonal to the linear portion of the antenna element of the plurality of antenna elements.

14. The wireless device according to claim 11, wherein the conductive line path includes:

two first conductive lines respective one ends of which are connected to the end portion of the substrate and which are substantially orthogonal to a face of the substrate; and a second conductive line both ends of which are respectively connected to respective other ends of the first conductive lines and substantially in parallel with the face of the substrate;

wherein an element length of the first conductive line is shorter than a twentieth wavelength and longer than a tenth wavelength.

15. The wireless device according to claim 14, comprising:

a dielectric layer arranged on the substrate, wherein the conductive line path is arranged at a surface of the dielectric layer.

16. The wireless device according to claim 11, comprising:

a switching unit configured to switch an electric element length of the conductive line path; and a controlling unit configured to control the switching unit in accordance with a signal transmitted and received through an antenna element of the plurality of antenna elements, wherein the controlling unit controls the switching unit to switch an electric element length of the conductive line path so as to make the path difference a half wavelength of a frequency of the signal.

17. The wireless device according to claim 16, wherein the conductive line path includes two of third conductive lines one ends of which are connected to the end portion of the substrate and other ends of which are connected to the switching unit; and wherein the switching unit includes a plurality of linear elements respectively having different electric element lengths and a switch for respectively connecting one of both ends of the plurality of linear elements and respective other ends of the two third conductive lines based on a control of the controlling unit.

18. The wireless device according to claim 16, wherein the switching unit connects a plurality of capacity elements respective one ends of which are connected to the substrate and capacitance values of which differ from each other and one of the plurality of capacitance elements and the conductive line path based on a control of the controlling unit.

19. The wireless device according to claim 16, wherein the switching unit includes:

a variable capacitance element one of which is connected to the substrate; and a switch configured to switch connection/cutting of the variable capacitance element and the conductive line path based on a control of the controlling unit, and wherein the controlling unit changes the electric element length of the conductive line path by controlling connection/cutting of the switch and a capacitance value of the variable capacitance element.

* * * * *